US011913212B2

(12) United States Patent
Lin

(10) Patent No.: US 11,913,212 B2
(45) Date of Patent: Feb. 27, 2024

(54) BIDET FOLDING STRUCTURE

(71) Applicant: Xiamen Shengborui Technology Co., Ltd., Fujian (CN)

(72) Inventor: Liye Lin, Fujian (CN)

( * ) Notice: Subject to any disclaimer, the term of this patent is extended or adjusted under 35 U.S.C. 154(b) by 0 days.

(21) Appl. No.: 18/374,672

(22) Filed: Sep. 29, 2023

(65) Prior Publication Data

US 2024/0026672 A1 Jan. 25, 2024

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/447–448, 443
See application file for complete search history.

(56) References Cited

U.S. PATENT DOCUMENTS 4,553,274 A * 11/1985 Yui ..... E03D 9/08 4/236
4,628,548 A * 12/1986 Kurosawa ..... G05B 19/40 4/443
6,167,577 B1 * 1/2001 Hammad ..... E03D 9/08 4/420.4
6,526,602 B2 * 3/2003 Jeon ..... E03D 9/08 4/420.4
6,675,399 B1 * 1/2004 Tomita ..... E03D 9/08 4/422
8,161,580 B2 * 4/2012 Hashidume ..... E03D 9/08 4/444
11,499,304 B1 * 11/2022 Bensing ..... F16K 11/08
2002/0042946 A1 * 4/2002 Jeon ..... E03D 9/08 4/420.4
2023/0193613 A1 * 6/2023 Fang ..... A47K 13/24 4/447
2023/0295911 A1 * 9/2023 Jiang ..... B05B 1/30 4/420.4

FOREIGN PATENT DOCUMENTS

CN 115030278 A * 9/2022

* cited by examiner

*Primary Examiner* — Lori L Baker

(57) ABSTRACT

A bidet folding structure, including a fixed plate and a mounting seat which are separately formed; the fixed plate and the mounting seat are rotatably connected through a rotating shaft perpendicular to the fixed plate, allowing the mounting seat to fold into a state parallel to the fixed plate. The fixed plate and the mounting seat are structurally separated, and the two are rotatably fitted through the rotating shaft. This enables the folding of the mounting seat, so that the mounting seat can be folded to position below the fixed plate at a 0° state.

9 Claims, 7 Drawing Sheets

BIDET FOLDING STRUCTURE

BACKGROUND OF THE INVENTION

The present invention relates to the technical field of bidets, and in particular to a bidet folding structure.

A bidet refers to a device with the function of washing the lower part of the human body for defecation. It can be designed as an integral part of a toilet seat or installed as a separate device on the hinges of a toilet. For the latter case, the structure of the bidet typically includes a fixed plate installed on the hinges of the toilet, along with a mounting seat integrally connected to the fixed plate. Several water outlets for different functions are formed on the fixed plate, and a water inlet is formed on the mounting seat. Multiple water paths are arranged between the water inlet and the water outlets, and a valve core that controls the switching of water paths is installed inside the mounting seat. Users usually rotate a knob or press a button on the mounting seat to control the valve core, thereby switching the bidet to different operating modes (such as self-cleaning, hip wash, and feminine wash).

Generally, to facilitate the installation of the bidet, the thickness of its fixed plate is limited to a certain range. To ensure that the fixed plate, within this limited thickness, has sufficient strength for installation, two fixed rings or fixed holes for assembly to the toilet are usually designed on the fixed plate. The positions of the fixed rings/fixed holes correspond to the positions of installation holes on the toilet for installing the hinges, so that the fixed plate basically spans the entire rear end of the toilet. In other words, the outer shape of the fixed plate is a flat and elongated panel, and one end of the fixed plate is integrally connected to the mounting seat (typically at a 90° angle, after the installation of bidet on the toilet, the mounting seat thereof is positioned just at the side of the toilet seat, making it easy to operate), creating an overall L-shaped device for the bidet. From the perspective of product packaging, an L-shaped product would result in wasted packaging space, leading to larger packaging volume and increased packaging complexity.

BRIEF SUMMARY OF THE INVENTION

The objective of the present invention is to provide a bidet folding structure that addresses issues in the prior art. This design enables the bidet to have a folding capability, allowing the mounting seat to fold relative to the fixed plate, thereby reducing storage volume and facilitating packaging.

To achieve the above objective, the present invention adopts the following solutions:

A bidet folding structure, comprising a fixed plate and a mounting seat which are separately formed; the fixed plate and the mounting seat are rotatably connected through a rotating shaft perpendicular to the fixed plate, allowing the mounting seat to fold into a state parallel to the fixed plate.

Preferably, the bidet folding structure further comprises sealing rings, a first valve core and a water discharge device; several water discharge channels are provided within the fixed plate, with inlet ends of the water discharge channels all connected to a peripheral surface of the rotating shaft, which is provided at a lower surface of one end of the fixed plate; communication points between the water discharge channels and the peripheral surface of the rotating shaft are offset along an axial direction of the rotating shaft; the sealing rings sleeved on the peripheral surface of the rotating shaft are provided both between adjacent communication points and at two ends of the rotating shaft; at least one inlet pipe is provided in the mounting seat, and several water distribution channels are provided within the mounting seat, with outlet ends of the water distribution channels all connected to a side wall of a shaft groove, which is provided at one end of an upper surface of the mounting seat; the rotating shaft is rotatably fitted inside the shaft groove, and an end of the rotating shaft is axially limited by the mounting seat; the sealing rings are tightly fitted between the peripheral surface of the rotating shaft and the side wall of the shaft groove, and the water distribution channels are connected to the water discharge channels, respectively; the first valve core is installed within the mounting seat to switch communication between the inlet pipe and inlet ends of respective water distribution channels; the water discharge device is installed on the fixed plate and is connected to outlet ends of the water discharge channels.

Preferably, the water discharge channels are three in number and the water distribution channels are three in number; the water discharge channels comprise a first self-cleaning channel, a first hip wash channel and a first feminine wash channel; the water distribution channels comprise a second self-cleaning channel, a second hip wash channel and a second feminine wash channel; the first self-cleaning channel is connected to the second self-cleaning channel, the first hip wash channel is connected to the second hip wash channel, and the first feminine wash channel is connected to the second feminine wash channel.

Preferably, a first bypass channel, a second bypass channel and a third bypass channel are provided along the axial direction of the rotating shaft; a first bypass hole, a second bypass hole and a third bypass hole are formed on the peripheral surface of the rotating shaft, and the first bypass hole, the second bypass hole, and the third bypass hole are offset along the axial direction of the rotating shaft; two ends of the first bypass channel are respectively connected to the first self-cleaning channel and the first bypass hole; two ends of the second bypass channel are respectively connected to the first hip wash channel and the second bypass hole; two ends of the third bypass channel are respectively connected to the first feminine wash channel and the third bypass hole; the sealing rings sleeved on the rotating shaft are four in number.

Preferably, a fourth bypass hole, a fifth bypass hole and a sixth bypass hole are formed on the side wall of the shaft groove, and the fourth bypass hole, the fifth bypass hole and the sixth bypass hole are offset along an axial direction of the shaft groove; the fourth bypass hole is connected to the second self-cleaning channel, the fifth bypass hole is connected to the second hip wash channel, and the sixth bypass hole is connected to the second feminine wash channel; the fourth bypass hole is connected to the first bypass hole, the fifth bypass hole is connected to the second bypass hole, and the sixth bypass hole is connected to the third bypass hole.

Preferably, the inlet pipes are two in number; a first bypass chamber is provided within the mounting seat; an outlet end of the first bypass chamber is connected to the inlet ends of the respective water distribution channels; the first valve core is installed within the first bypass chamber; a second bypass chamber is provided within the mounting seat; the two inlet pipes are both connected to an inlet end of the second bypass chamber, and an outlet end of the second bypass chamber is connected to the inlet end of the first bypass chamber; a second valve core is installed within the second bypass chamber.

Preferably, the fixed plate comprises detachably connected first panel and second panel; the rotating shaft and the water discharge channels are both provided on the first panel; fixed disks for assembly to the toilet are provided on both the first panel and the second panel; a guide groove is formed on an end surface of the first panel distant from the rotating shaft; the guide groove has a first end which is a closed structure and a second end which is provided with a stop groove; a guide flange is formed on an end surface of the second panel facing the first panel, and a latch is provided on the second panel at a position corresponding to the stop groove; the guide flange is slidably fitted into the guide groove and abuts against a closed end of the guide groove; the latch is hooked in the stop groove.

Preferably, a slot hole is formed on the fixed disk which is hooked in a circular hole of the first panel or the second panel through snap buttons; the fixed disk is rotatably fitted with the first panel or the second panel.

The bidet folding structure further comprises a screw inserted through the lower surface of the mounting seat; the screw is threadedly connected to an end surface of the rotating shaft.

The water discharge device comprises a housing hermetically connected to an outlet end of the fixed plate, and piston rods and springs provided within the housing; moving channels corresponding to the piston rods are provided in the housing; the piston rods are movably and hermetically fitted within the moving channels and extend out of the housing under action of water pressure when water enters the moving channels; the springs are sleeved on peripheral surfaces of the piston rods and abut against ends of the moving channels to drive the piston rods to return to their initial positions.

After adopting the above technical solutions, the present invention has the following technical effects:

1. The fixed plate and the mounting seat are structurally separated, and the two are rotatably fitted through the rotating shaft. This enables the folding of the mounting seat, so that the mounting seat can be folded to position below the fixed plate at a 0° state. As a result, it reduces the storage volume of the bidet, facilitating packaging and lowering packaging and transportation costs.
2. Users can freely adjust the angle of the mounting seat when using the bidet, making it convenient to operate the knob or button thereon.

DETAILED DESCRIPTION OF THE INVENTION

To further explain the technical solutions of the present invention, a detailed description of the present invention is provided below through specific embodiments.

Figure 1:
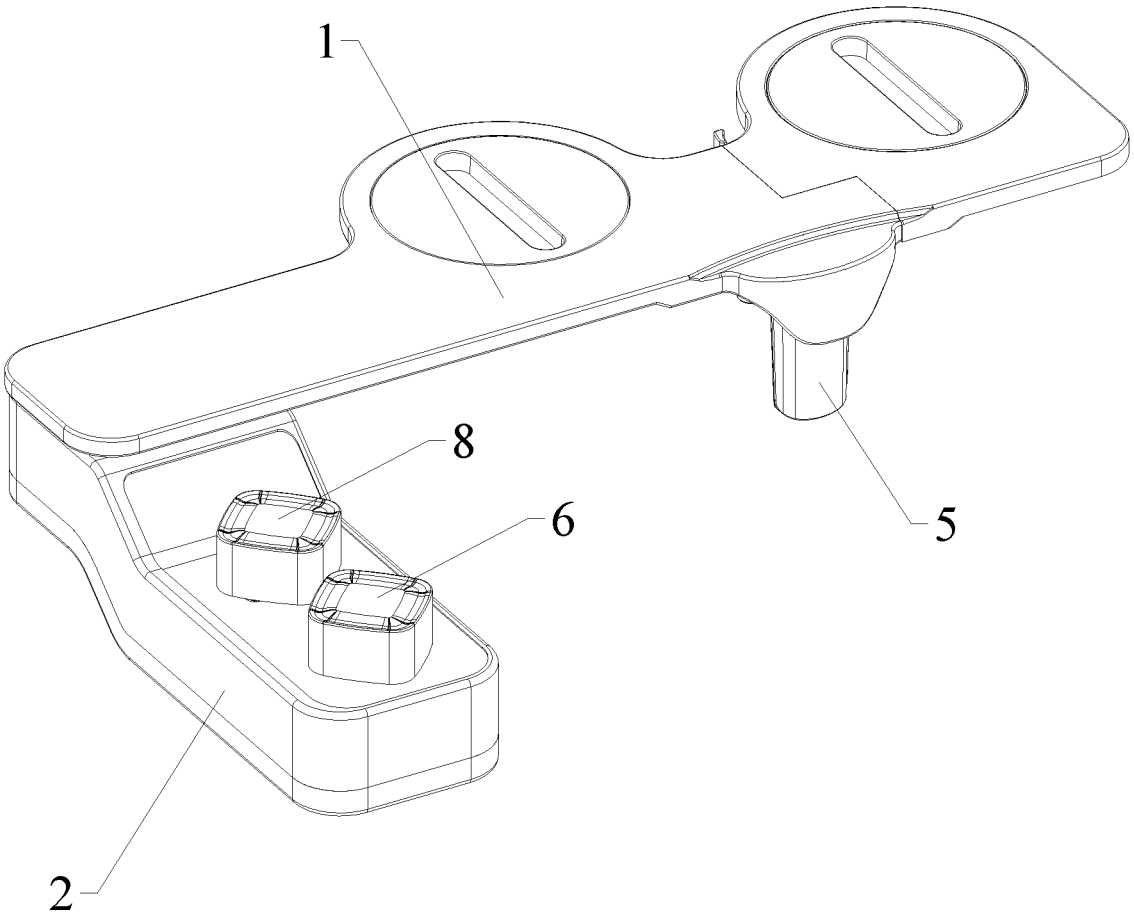
FIG. 1 is a perspective view of a specific embodiment according to the present invention.
Figure 2:
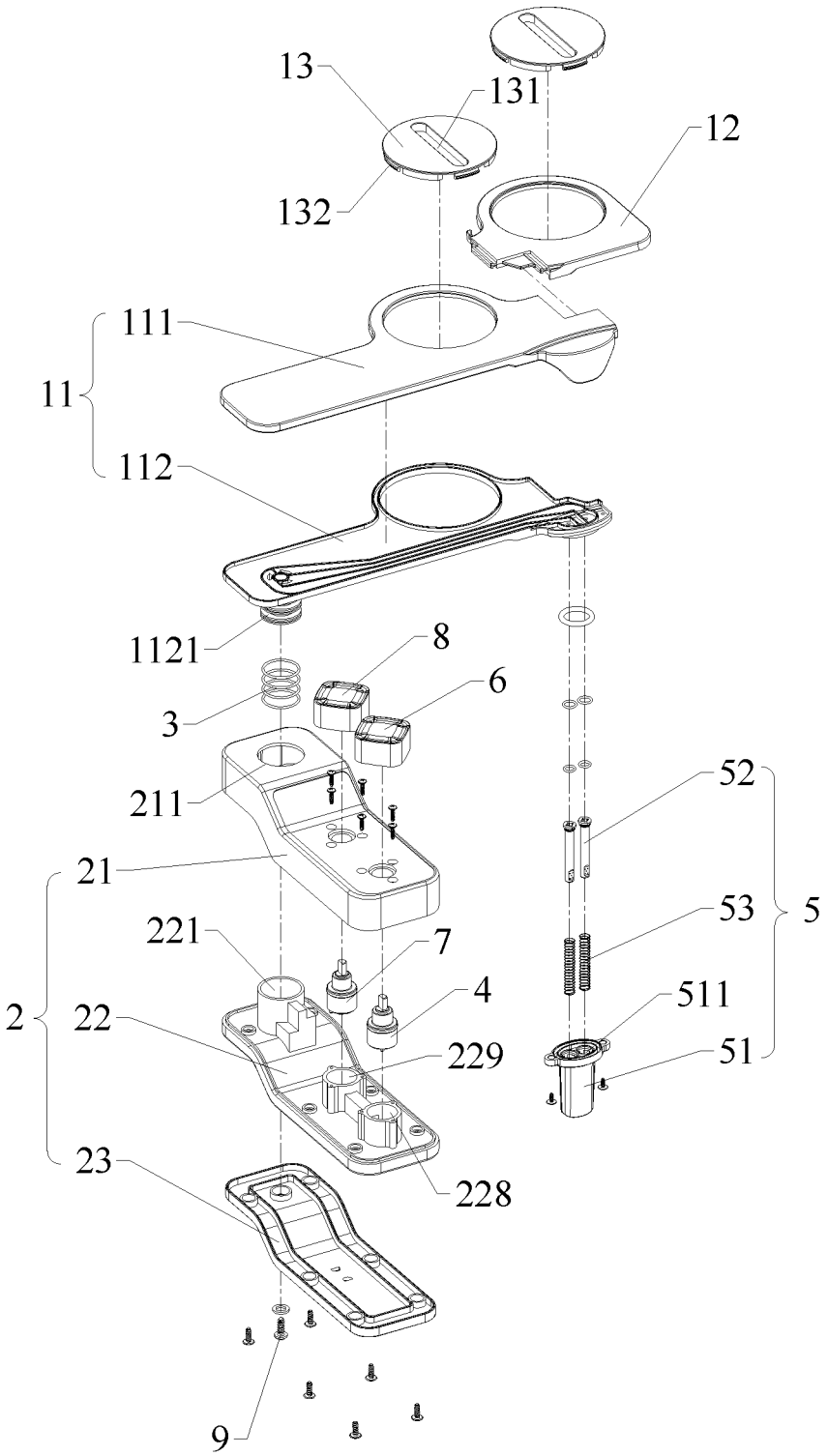
FIG. 2 is an exploded view of a specific embodiment according to the present invention.
Figure 3:
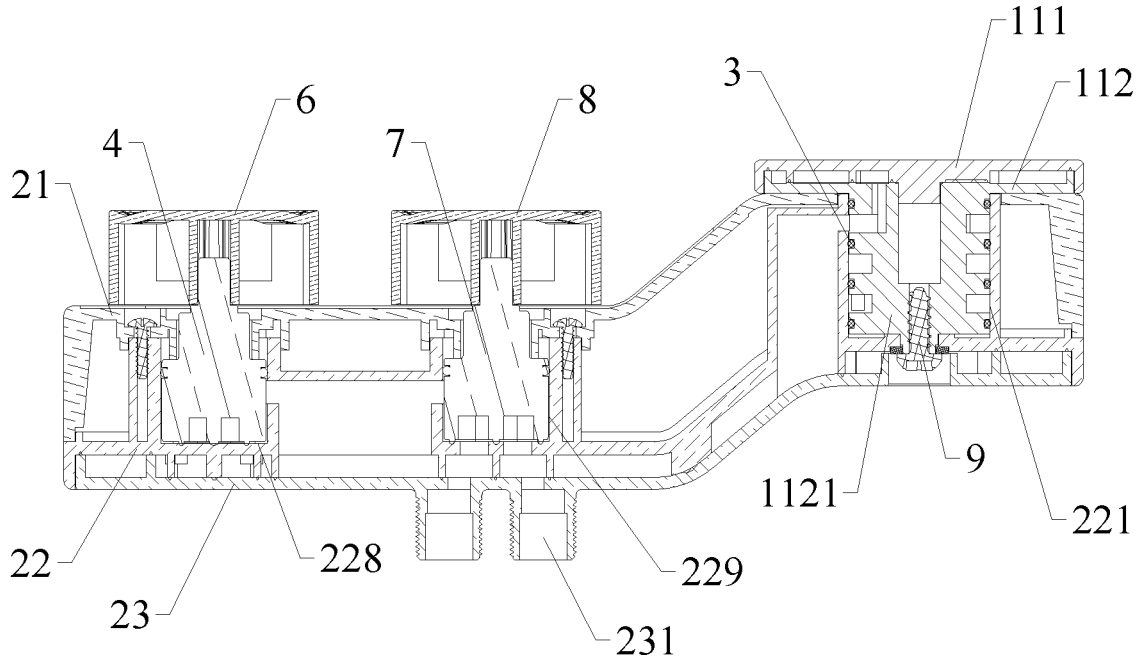
FIG. 3 is a cross-sectional view of a specific embodiment according to the present invention.
Figure 4:
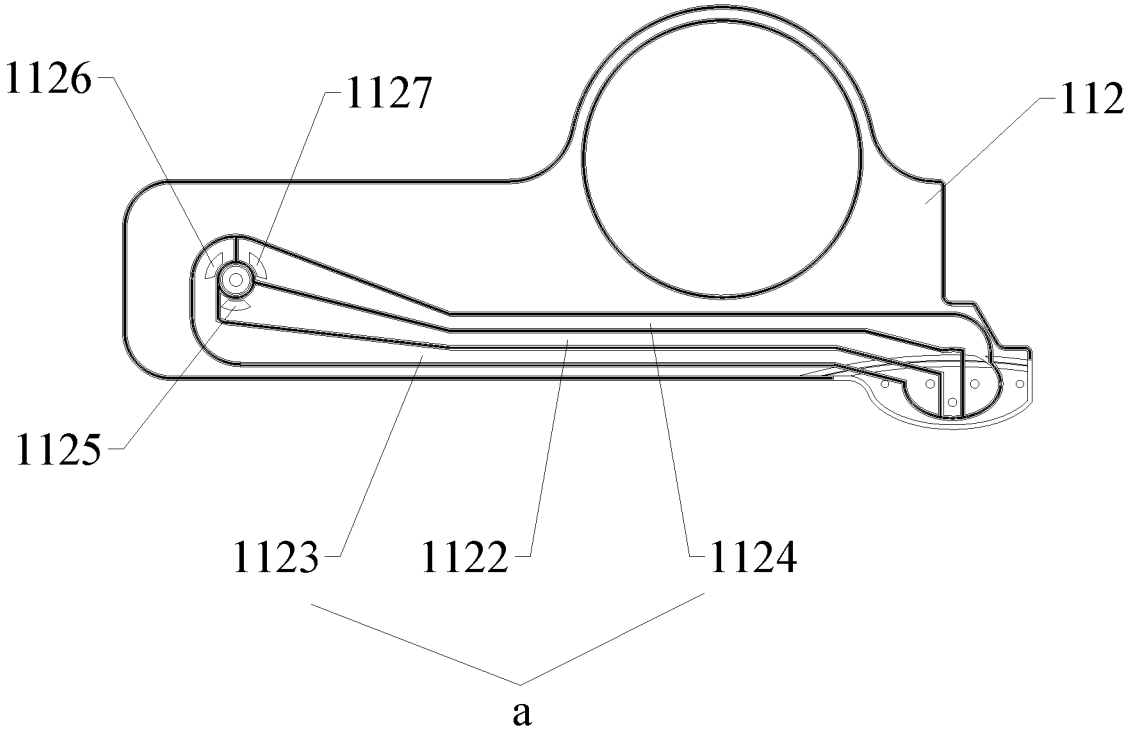
FIG. 4 is a top view of a first lower cover according to a specific embodiment of the present invention.
Figure 5:
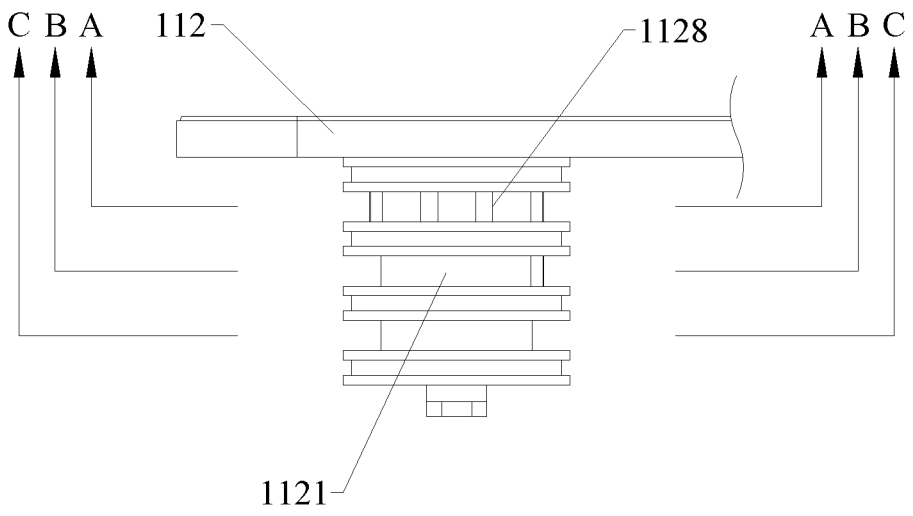
FIG. 5 is a partial structural front view of a first lower cover according to a specific embodiment of the present invention.
Figure 6:
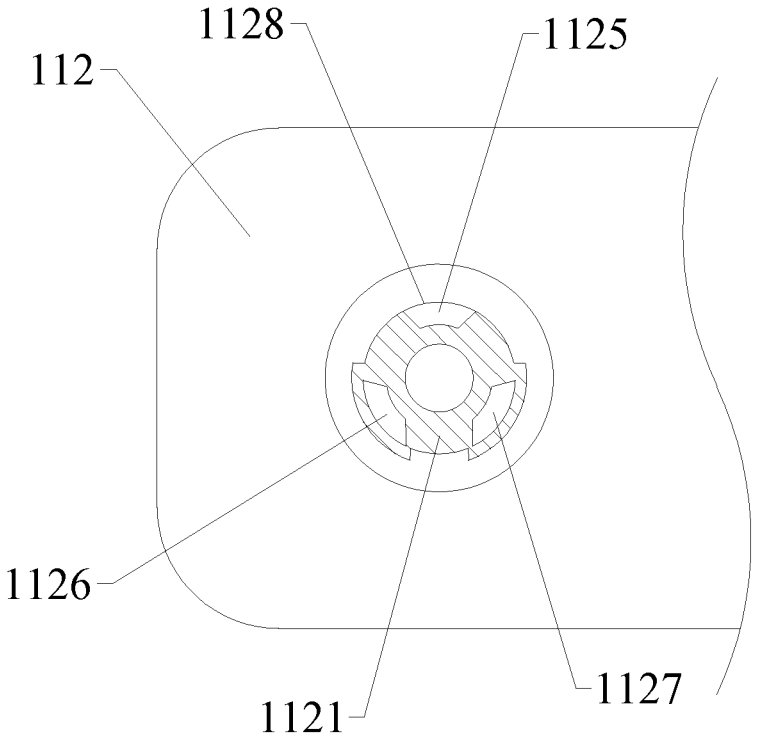
FIG. 6 is a cross-sectional view taken along the direction of A-A in FIG. 5.
Figure 7:
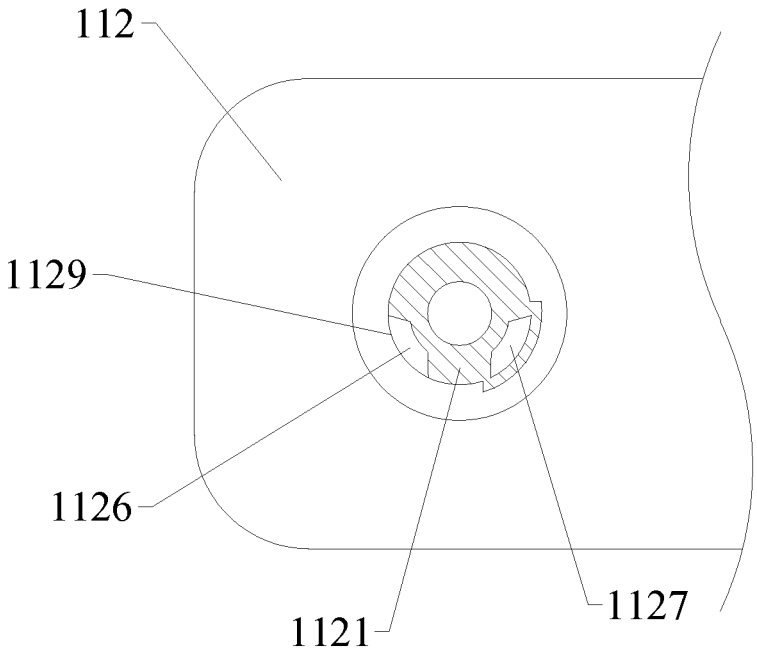
FIG. 7 is a cross-sectional view taken along the direction of B-B in FIG. 5.
Figure 8:
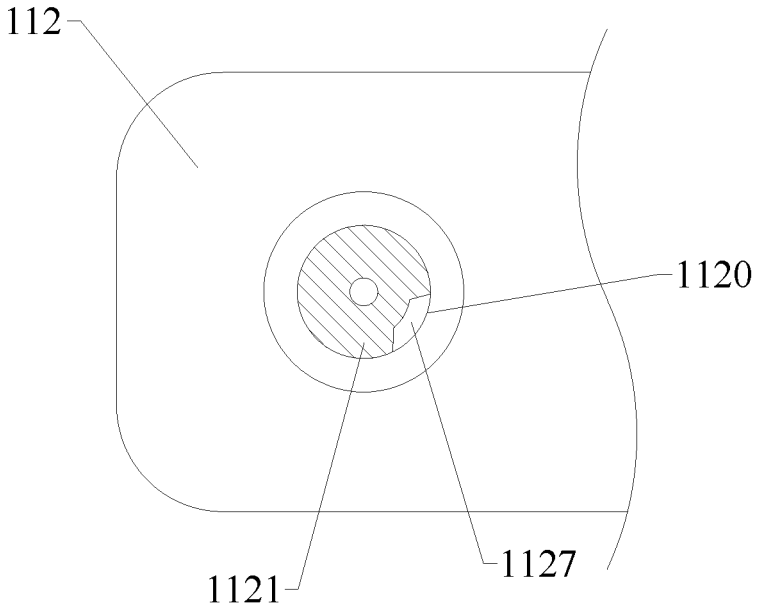
FIG. 8 is a cross-sectional view taken along the direction of C-C in FIG. 5.
Figure 9:
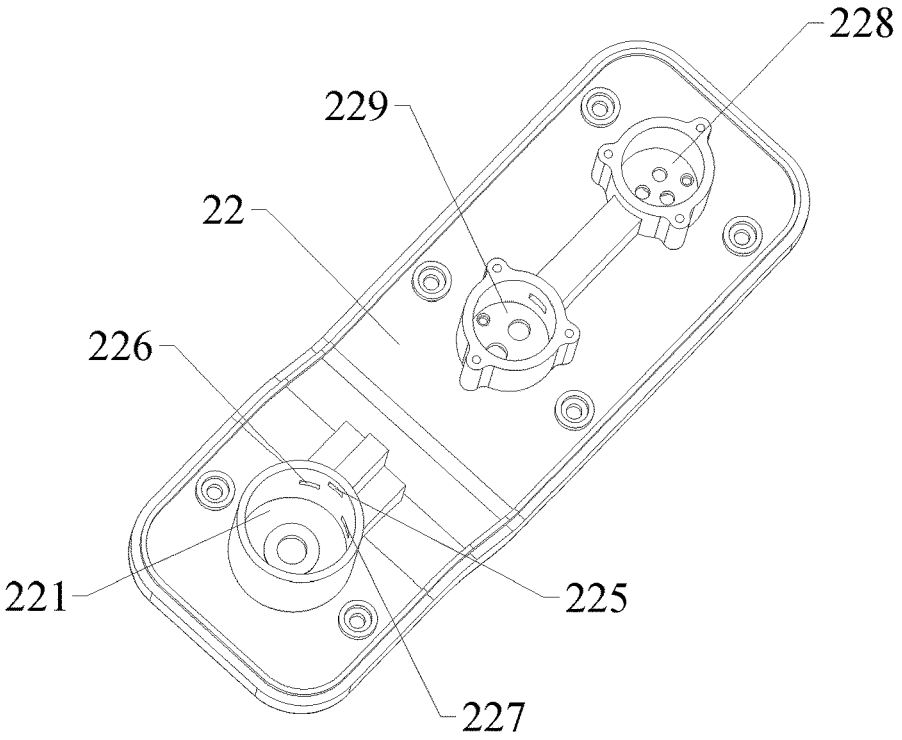
FIG. 9 is a perspective view of a mounting seat body according to a specific embodiment of the present invention.
Figure 10:
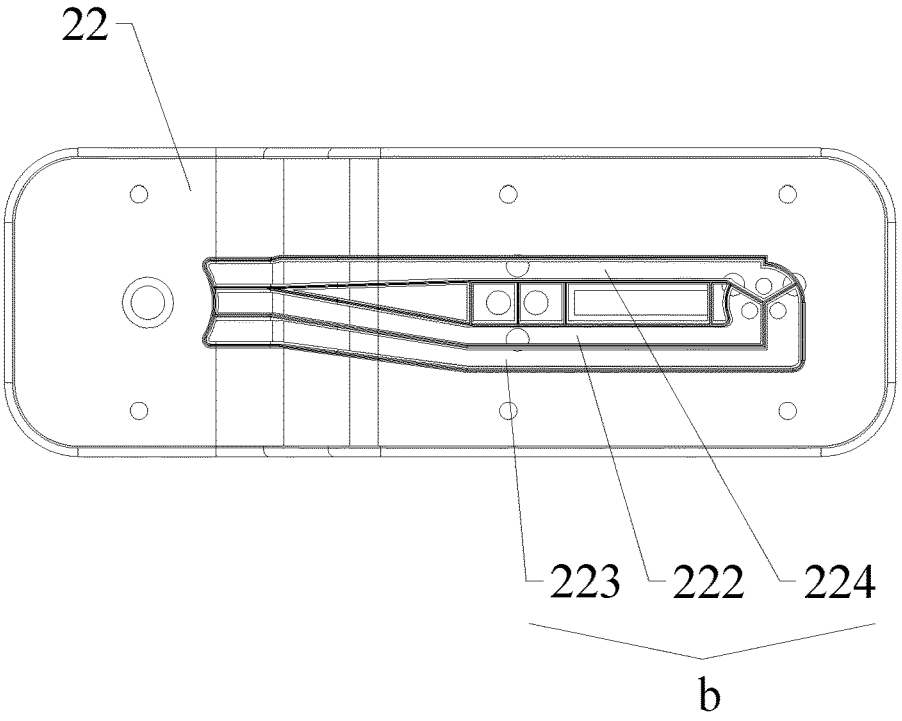
FIG. 10 is a bottom view of a mounting seat body according to a specific embodiment of the present invention.
Figure 11:
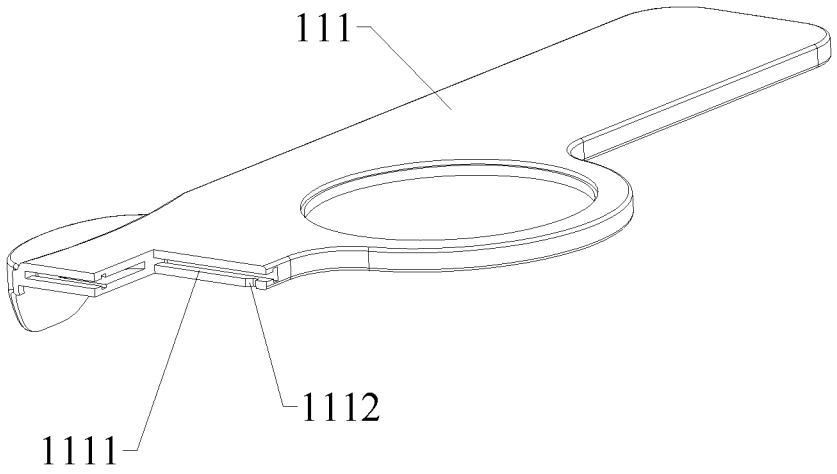
FIG. 11 is a perspective view of a first upper cover according to a specific embodiment of the present invention.
Figure 12:
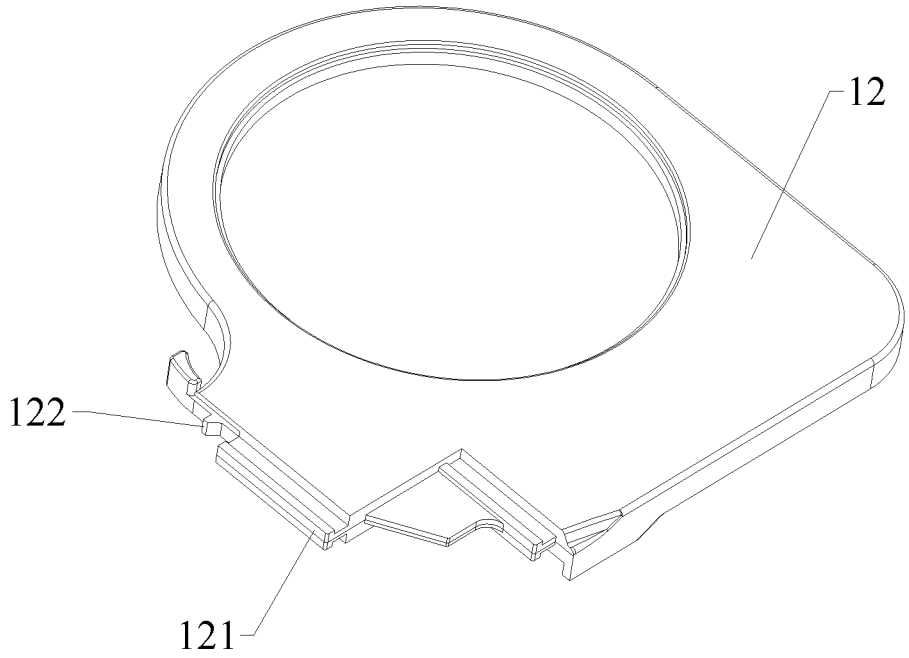
FIG. 12 is a perspective view of a second panel according to a specific embodiment of the present invention.

Referring to FIGS. 1 to 12, the present invention discloses a bidet folding structure, comprising a fixed plate 1 and a mounting seat 2 which are separately formed. The fixed plate 1 and the mounting seat 2 are rotatably connected through a rotating shaft 1121 perpendicular to the fixed plate 1, allowing the mounting seat 2 to fold into a state parallel to the fixed plate 1.

The following describes specific embodiments of the present invention.

The present invention further comprises sealing rings 3, a first valve core 4, and a water discharge device 5. Several water discharge channels a are provided within the fixed plate 1, with inlet ends of the water discharge channels a all connected to a peripheral surface of the rotating shaft 1121, which is provided at a lower surface of one end of the fixed plate 1. The communication points between the water discharge channels a and the peripheral surface of the rotating shaft 1121 are offset along an axial direction of the rotating shaft 1121. The sealing rings 3 sleeved on the peripheral surface of the rotating shaft 1121 are provided both between adjacent communication points and at two ends of the rotating shaft 1121. At least one inlet pipe 231 is provided in the mounting seat 2, and several water distribution channels b are provided within the mounting seat 2, with outlet ends of the water distribution channels b all connected to a side wall of a shaft groove 221, which is provided at one end of an upper surface of the mounting seat 2. The rotating shaft 1121 is rotatably fitted inside the shaft groove 221, and an end of the rotating shaft 1121 is axially limited by the mounting seat 2 to prevent the rotating shaft 1121 from disengaging from the shaft groove 221. The sealing rings 3 are tightly fitted between the peripheral surface of the rotating shaft 1121 and the side wall of the shaft groove 221, and the water distribution channels b are connected to the water discharge channels a, respectively. The first valve core 4 is installed within the mounting seat 2 to switch communication between the inlet pipe 231 and inlet ends of respective water distribution channels b. The water discharge device 5 is installed on the fixed plate 1 and is connected to outlet ends of the water discharge channels a.

In the above-described structure, the fixed plate 1 and the mounting seat 2 are separately formed according to the present invention. The rotating shaft 1121 of the fixed plate 1 is rotatably fitted in the shaft groove 221 of the mounting seat 2. Furthermore, the axial limitation of the rotating shaft 1121 by the mounting seat 2 ensures an unobstructed, sealed, and stable connection between the water discharge channels a of the fixed plate 1 and the water distribution channels b of the mounting seat 2. The sealing rings 3 are used to separate the water inlet channels and the water distribution channels b, ensuring the independence and non-interference between the functions of the bidet. Meanwhile, the present invention ensures that the water path switching function of the bidet is controlled by the first valve core 4 on the mounting seat 2, which is a purely mechanical structure and does not require electric control, making the internal structure of the bidet simpler and the production cost lower.

In the specific implementation of the aforementioned folding structure, a total of three water discharge channels a and three water distribution channels b are provided. The water discharge channels a comprise a first self-cleaning channel 1122, a first hip wash channel 1123, and a first feminine wash channel 1124. The water distribution channels b comprise a second self-cleaning channel 222, a second hip wash channel 223, and a second feminine wash channel 224. The first self-cleaning channel 1122 is connected to the second self-cleaning channel 222, the first hip wash channel 1123 is connected to the second hip wash channel 223, and the first feminine wash channel 1124 is connected to the second feminine wash channel 224.

Furthermore, a first bypass channel 1125, a second bypass channel 1126, and a third bypass channel 1127 are provided along the axial direction of the rotating shaft 1121. A first bypass hole 1128, a second bypass hole 1129, and a third bypass hole 1120 are formed on the peripheral surface of the rotating shaft 1121, and the first bypass hole 1128, the second bypass hole 1129, and the third bypass hole 1120 are offset along the axial direction of the rotating shaft 1121. Two ends of the first bypass channel 1125 are respectively connected to the first self-cleaning channel 1122 and the first bypass hole 1128; two ends of the second bypass channel 1126 are respectively connected to the first hip wash channel 1123 and the second bypass hole 1129; two ends of the third bypass channel 1127 are respectively connected to the first feminine wash channel 1124 and the third bypass hole 1120. Correspondingly, four sealing rings 3 are sleeved on the rotating shaft 1121.

Secondly, a fourth bypass hole 225, a fifth bypass hole 226, and a sixth bypass hole 227 are formed on the side wall of the shaft groove 221, and the fourth bypass hole 225, the fifth bypass hole 226, and the sixth bypass hole 227 are offset along an axial direction of the shaft groove 221. The fourth bypass hole 225 is connected to the second self-cleaning channel 222, the fifth bypass hole 226 is connected to the second hip wash channel 223, and the sixth bypass hole 227 is connected to the second feminine wash channel 224. Additionally, the fourth bypass hole 225 is connected to the first bypass hole 1128, the fifth bypass hole 226 is connected to the second bypass hole 1129, and the sixth bypass hole 227 is connected to the third bypass hole 1120.

The inlet pipes 231 are two in number, which connect cold and hot water pipes respectively. A first bypass chamber 228 is provided within the mounting seat 2. An outlet end of the first bypass chamber 228 is connected to the inlet ends of the respective water distribution channels b. The first valve core 4 is installed within the first bypass chamber 228. A second bypass chamber 229 is provided within the mounting seat 2. The two inlet pipes 231 are both connected to an inlet end of the second bypass chamber 229, and an outlet end of the second bypass chamber 229 is connected to the inlet end of the first bypass chamber 228. A second valve core 7 is installed within the second bypass chamber 229. In this embodiment, the first valve core 4 and the second valve core 7 are function-switching valve core and temperature-adjusting valve core, respectively. The former is used to switch the operating modes of the bidet, and the latter is used to regulate the discharged water temperature of the bidet. A first knob 6 is provided for the control end of the first valve core 4, allowing users to operate and control the first valve core 4 to switch the operating modes of the bidet. A second knob 8 is provided for the control end of the second valve core 7, allowing users to operate and control the second valve core 7 to regulate the water temperature.

The fixed plate 1 comprises detachably connected first panel 11 and second panel 12. The rotating shaft 1121 and the water discharge channels a are both provided on the first panel 11. Fixed disks 13 for assembly to the toilet are provided on both the first panel 11 and the second panel 12. Splitting the fixed plate 1 further into separate first panel 11 and second panel 12 can further reduce the overall length of the product during packaging, thereby reducing the packaging volume and lowering the packaging cost.

Furthermore, a guide groove 1111 is formed on an end surface of the first panel 11 distant from the rotating shaft 1121. The guide groove 1111 has a first end which is a closed structure and a second end which is provided with a stop groove 1112. A guide flange 121 is formed on an end surface of the second panel 12 facing the first panel 11, and a latch 122 is provided on the second panel 12 at a position corresponding to the stop groove 1112. The guide flange 121 is slidably fitted into the guide groove 1111 and abuts against a closed end of the guide groove 1111. The latch 122 is hooked in the stop groove 1112, restricting the movement of the guide flange 121 in the extending direction of the guide groove 1111. When it is necessary to disassemble the first panel 11 and the second panel 12, the first panel 11 and the second panel 12 can be slid apart after unlocking the latch 122. The guide groove 1111 and the guide flange 121 may have T-shaped, L-shaped, or triangular structures.

Secondly, a slot hole 131 is formed on the fixed disk 13 which is hooked in a circular hole of the first panel 11/second panel 12 through snap buttons 132. The fixed disk 13 is rotatably fitted with the first panel 11/second panel 12. By rotating the fixed disk 13, the direction of the slot hole 131 can be adjusted, facilitating the installation of the fixed plate 1 on the toilet.

In this embodiment, the first panel 11 comprises a first upper cover 111 and a first lower cover 112 detachably connected by screws. The guide groove 1111 and the stop groove 1112 are formed on the first upper cover 111, while the rotating shaft 1121 and the water discharge channels a are provided on the first lower cover 112. The mounting seat 2 comprises a second upper cover 21, a mounting body 22, and a second lower cover 23 detachably connected by screws. A through hole 211 for the rotating shaft 1121 to pass through is formed on the second upper cover 21. The shaft groove 221, the water distribution channels b, the first bypass chamber 228, and the second bypass chamber 229 are all provided on the mounting body 22. The inlet pipe 231 is provided on a lower surface of the second lower cover 23.

The present invention further comprises a screw 9 inserted through the lower surface of the mounting seat 2. The screw 9 is threadedly connected to an end surface of the rotating shaft 1121, achieving axial limitation of the rotating shaft 1121 within the shaft groove 221. This facilitates disassembly and assembly while ensuring that the rotating shaft 1121 does not disengage from the shaft groove 221.

The water discharge device 5 comprises a housing 51 hermetically connected to an outlet end of the fixed plate 1, and piston rods 52 and springs 53 provided within the housing 51. Moving channels 511 corresponding to the piston rods 52 are provided in the housing 51. The piston rods 52 are movably and hermetically fitted within the moving channels 511 and extend out of the housing 51 under action of water pressure when water enters the moving channels 511, so as to perform the corresponding function (e.g., hip wash, feminine wash). The springs 53 are sleeved on peripheral surfaces of the piston rods 52 and abut against ends of the moving channels 511 to drive the piston rods 52 to return to their initial positions. The water discharge device with such a structure can automatically extend the corresponding piston rod 52 under the action of water pressure when water fills the corresponding water discharge channel a (such as the first hip wash channel 1123 and the first feminine wash channel 1124), without the need for an electrically driven structure. This makes the product structure simpler and the cost lower.

With the above solution, the fixed plate 1 and the mounting seat 2 are structurally separated according to the present invention, and the two are rotatably fitted through the rotating shaft 1121. This enables the folding of the mounting seat 2, so that the mounting seat 2 can be folded to position below the fixed plate 1 at a 0° state. As a result, it reduces the storage volume of the bidet, facilitating packaging and lowering packaging and transportation costs. Meanwhile, users can freely adjust the angle of the mounting seat 2 when using the bidet, making it convenient to operate the knob or button thereon.

What is claimed is:

1. A bidet folding structure comprising:

a fixed plate and a mounting seat;

the fixed plate and the mounting seat are two separate components rotatably connected through a rotating shaft orienting perpendicular to the fixed plate; the rotating shaft is configured to allow the mounting seat to rotate into a state parallel to the fixed plate;

the bidet folding structure further comprises a plurality of sealing rings, a first valve core and a water discharge device;

a plurality of water discharge channels are formed within the fixed plate;

inlet ends of the water discharge channels are connected to a peripheral surface of the rotating shaft; the rotating shaft is extends from a lower surface of one end of the fixed plate;

the plurality of sealing rings sleeve the peripheral surface of the rotating shaft;

at least one inlet pipe is arranged on the mounting seat, and a plurality of water distribution channels are formed within the mounting seat;

outlet ends of the water distribution channels are connected to a side wall of a shaft groove; the shaft groove is arranged at one end of an upper surface of the mounting seat; the rotating shaft is rotatably fitted inside the shaft groove, and an end of the rotating shaft is axially limited by the mounting seat;

the plurality of sealing rings are fitted between the peripheral surface of the rotating shaft and the side wall of the shaft groove; the water distribution channels are connected to the water discharge channels respectively; the first valve core is installed within the mounting seat to switch communication between the said at least one inlet pipe and inlet ends of respective water distribution channels; the water discharge device is installed on the fixed plate and is connected to outlet ends of the water discharge channels.

2. The bidet folding structure of claim 1, wherein said plurality of water discharge channels comprises three water discharge channels, and said plurality of water distribution channels comprises three water distribution channels; the three water discharge channels comprise a first self-cleaning channel, a first hip wash channel and a first feminine wash channel; the three water distribution channels comprises a second self-cleaning channel, a second hip wash channel and a second feminine wash channel; the first self-cleaning channel is connected to the second self-cleaning channel, the first hip wash channel is connected to the second hip wash channel, and the first feminine wash channel is connected to the second feminine wash channel.

3. The bidet folding structure of claim 2, wherein a first bypass channel, a second bypass channel and a third bypass channel are arranged along the axial direction of the rotating shaft; a first bypass hole, a second bypass hole and a third bypass hole are formed on the peripheral surface of the rotating shaft, and the first bypass hole, the second bypass hole, and the third bypass hole are offset along the axial direction of the rotating shaft; two ends of the first bypass channel are connected to the first self-cleaning channel and the first bypass hole respectively; two ends of the second bypass channel are connected to the first hip wash channel and the second bypass hole respectively; two ends of the third bypass channel are connected to the first feminine wash channel and the third bypass hole respectively; said plurality of sealing rings comprise four sealing rings.

4. The bidet folding structure of claim 3, wherein a fourth bypass hole, a fifth bypass hole and a sixth bypass hole are formed on the side wall of the shaft groove, and the fourth bypass hole, the fifth bypass hole and the sixth bypass hole are offset along an axial direction of the shaft groove; the fourth bypass hole is connected to the second self-cleaning channel, the fifth bypass hole is connected to the second hip wash channel, and the sixth bypass hole is connected to the second feminine wash channel; the fourth bypass hole is connected to the first bypass hole, the fifth bypass hole is connected to the second bypass hole, and the sixth bypass hole is connected to the third bypass hole.

5. The bidet folding structure of claim 1, wherein said at least one inlet pipe comprises two inlet pipes; a first bypass chamber is formed within the mounting seat; an outlet end of the first bypass chamber is connected to the inlet ends of the respective water distribution channels; the first valve core is installed within the first bypass chamber; a second bypass chamber is formed within the mounting seat; both the two inlet pipes are connected to an inlet end of the second bypass chamber, and an outlet end of the second bypass chamber is connected to the inlet end of the first bypass chamber; a second valve core is installed within the second bypass chamber.

6. The bidet folding structure of claim 1, wherein the fixed plate comprises a first panel and a second panel detachably connected to each other; the rotating shaft and the water discharge channels are arranged on the first panel; fixed disks configured to assemble the bidet folding structure to a toilet are arranged on the first panel and the second panel respectively; a guide groove is formed on an end surface of the first panel distal from the rotating shaft; the guide groove has a first end which is a closed end and a second end formed with a stop groove; a guide flange is formed on an end surface of the second panel facing the first panel, and a latch is arranged on the second panel at a position corresponding to the stop groove; the guide flange is slidably fitted into the guide groove and abuts against the closed end of the guide groove; the latch is latched in the stop groove.

7. The bidet folding structure of claim 6, wherein a slot hole is formed on each of the fixed disks; the fixed disks are installed into circular holes of the first panel and the second panel respectively through snap fasteners; the fixed disks are rotatably fitted with the first panel and the second panel respectively.

8. The bidet folding structure of claim 1, further comprising a screw inserted through a lower surface of the mounting seat; the screw is threadedly connected to an end surface of the rotating shaft.

9. The bidet folding structure of claim 1, wherein the water discharge device comprises a housing hermetically connected to an outlet end of the fixed plate; piston rods and springs are installed in the housing; moving channels corresponding to the piston rods are formed in the housing; the piston rods are movably and hermetically fitted within the moving channels and are extendable out of the housing under action of water pressure when water enters the moving channels; the springs sleeve peripheral surfaces of the piston rods respectively and abut against ends of the moving channels to bias the piston rods to reset.

* * * * *